US009198543B1

(12) United States Patent
Hsieh

(10) Patent No.: US 9,198,543 B1
(45) Date of Patent: Dec. 1, 2015

(54) SOAP DISPENSER

(71) Applicant: His-Chin Hsieh, Changhua (TW)

(72) Inventor: His-Chin Hsieh, Changhua (TW)

(73) Assignee: Rin Shing Metal Co. Ltd., Changhua (TW)

( * ) Notice: Subject to any disclaimer, the term of this patent is extended or adjusted under 35 U.S.C. 154(b) by 0 days.

(21) Appl. No.: 14/285,432

(22) Filed: May 22, 2014

(51) Int. Cl.
*B05B 11/00* (2006.01)
*A47K 5/12* (2006.01)

(52) U.S. Cl.
CPC ..... *A47K 5/1211* (2013.01); *A47K 2005/1218* (2013.01); *B05B 11/0037* (2013.01)

(58) Field of Classification Search
CPC ..... E03C 1/102; E03C 1/184; F16K 24/00; B05B 11/0037
USPC ..... 222/78, 180, 321.1, 321.7–321.9; 137/216–218; 4/695
See application file for complete search history.

(56) References Cited

U.S. PATENT DOCUMENTS 3,183,923 A * 5/1965 Henrikson ..... E03C 1/102 137/216
3,512,545 A * 5/1970 Weaver ..... 137/216
3,929,149 A * 12/1975 Phillips ..... F16K 15/04 137/216
4,399,832 A * 8/1983 Appleby ..... 137/216
4,804,010 A * 2/1989 Meissenburg ..... E03C 1/04 137/216
4,910,808 A * 3/1990 Roth ..... B65D 83/28 222/182
5,713,385 A * 2/1998 Traylor ..... E03C 1/102 137/216
6,453,931 B1 * 9/2002 Traylor ..... E03C 1/12 137/216
6,510,863 B1 * 1/2003 Traylor ..... E03C 1/12 137/216
6,748,966 B1 * 6/2004 Dvorak ..... E03C 1/102 137/216
6,971,400 B1 * 12/2005 Bowman ..... E03C 1/12 137/216
7,210,599 B1 * 5/2007 Pfaff et al. ..... 222/78
7,673,648 B1 * 3/2010 Traylor ..... A61L 9/12 137/216

* cited by examiner

*Primary Examiner* — Daniel R Shearer
(74) *Attorney, Agent, or Firm* — Che-Yang Chen; Law Office o Michael Chen

(57) ABSTRACT

A soap dispenser may include a soap providing unit, an exhausting tube and a fitting unit. The fitting unit is disposed in the soap providing unit, and when an outlet pipe of the exhausting tube is disposed in a second receiving space of the soap providing unit, a fitting hole of fitting unit is used to cover the outlet pipe and protruding ribs of the fitting unit are used to secure the outer wall of the outlet pipe, and the soap providing unit can be securely positioned on the outlet pipe. The fitting unit is made by soft plastic materials so when the protruding ribs are used to secure the outer wall of the outlet pipe, the friction during the assembly process of the exhausting tube can be avoided to further reduce the chance of replacing the exhausting tube.

3 Claims, 7 Drawing Sheets

SOAP DISPENSER

FIELD OF THE INVENTION

This invention relates to a soap dispenser, and more particularly to a soap dispenser connecting to an exhausting hole.

BACKGROUND OF THE INVENTION

Referring to FIGS. 6 and 7 for a conventional soap dispenser connecting with an exhausting hole, the conventional soap dispenser may include an exhausting pipe 40, and a soap providing unit 50. There are two nuts 41 on top of the exhausting pipe 40 to secure the exhausting pipe 40 on the desktop of sinks in the kitchen or restroom, and a positioning rib 411 is formed surrounding the nuts 41. There is a receiving space 51 at the bottom of soap dispenser 50, and a common vent 52 in the receiving space 51 is corresponding to the outer portion of the soap providing unit 50. A stopper 511 is formed in the receiving space 51 corresponding to the positioning rib 411, so when the soap providing unit 50 is located at the top of the exhausting pipe 40, the soap providing unit 50 is disposed on top of the exhausting pipe 40 through the receiving space 51 through the engagement of the stopper 511 and the protruding rib 411.

The conventional soap dispenser may be disadvantageous because the conventional soap dispenser is secured through the engagement of the stopper 511 and the protruding rib 411, and most users would separate the soap providing unit 50 from the exhausting pipe 40 to fill the soap liquid, so the friction between the stopper 511 and the protruding rib 411 increases, which may lead to a problem that the soap providing unit 50 cannot be securely positioned on the exhausting pipe 40. The user may have to replace the parts to secure the soap providing unit 50. And the nuts 41 are usually sold with the exhausting pipe 40, so the user may have to buy the whole set of the exhausting pipe 40, and sometimes the whole set of the soap providing unit 50, which incurs extra costs to the users. Thus, there remains a need for a new and improved soap dispenser connecting to the exhausting hole to overcome the problems stated above.

SUMMARY OF THE INVENTION

Conventionally, the conventional soap dispenser is secured through the engagement of the stopper and the protruding rib, and most users would separate the soap providing unit from the exhausting pipe to fill the soap liquid, so the friction between the stopper and the protruding rib increases, which may lead to a problem that the soap providing unit cannot be securely positioned on the exhausting pipe. The user may have to replace the parts to secure the soap providing unit. And the nuts are usually sold with the exhausting pipe, so the user may have to buy the whole set of the exhausting pipe, and sometimes the whole set of the soap providing unit, which incurs extra costs to the users.

The present invention provides a soap dispenser including a soap providing unit, an exhausting tube and a fitting unit. The soap providing unit has a container that has a partition plate creating a first receiving space and a second receiving space, and a lid is disposed on a top opening of the first receiving space. The lid includes a pressing head, a suction tube extending to the first receiving space. The second receiving space has a stopper at an inner wall thereof, and a positioning rib is formed under the stopper while a through hole is formed above the stopper. The exhausting tube has an exhausting pipe and at least one inlet pipe at a bottom portion of the exhausting tube, and one side of the exhausting pipe has an exhausting hole. The fitting unit that is made by plastic is located in the second receiving space of the soap providing unit. A fitting hole is formed at a center portion of the fitting unit, and a plurality of protruding ribs is formed at an inner wall of the fitting hole. Also, a plurality of perforations are formed at an outer periphery of the fitting hole.

Comparing with conventional arts, the present invention is advantageous because (i) the fitting unit is disposed in the second receiving space, and more specifically, the fitting unit is positioned between the stopper and positioning rib, so when the exhausting pipe is disposed in the second receiving space, the fitting hole of fitting unit is used to cover the exhausting pipe and the protruding ribs are used to secure the outer wall of the exhausting pipe and the soap providing unit can be securely positioned above the exhausting pipe; and (ii) the fitting unit is made by soft plastic materials so when the protruding ribs are used to secure the outer wall of the exhausting pipe, the friction during the assembly process of the exhausting tube can be avoided to further reduce the chance of replacing the exhausting tube. Also, the fitting unit is disposed in the second receiving space of the soap providing unit, so when the soap providing unit and the exhausting tube cannot be smoothly connected, the user can replace the fitting unit.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
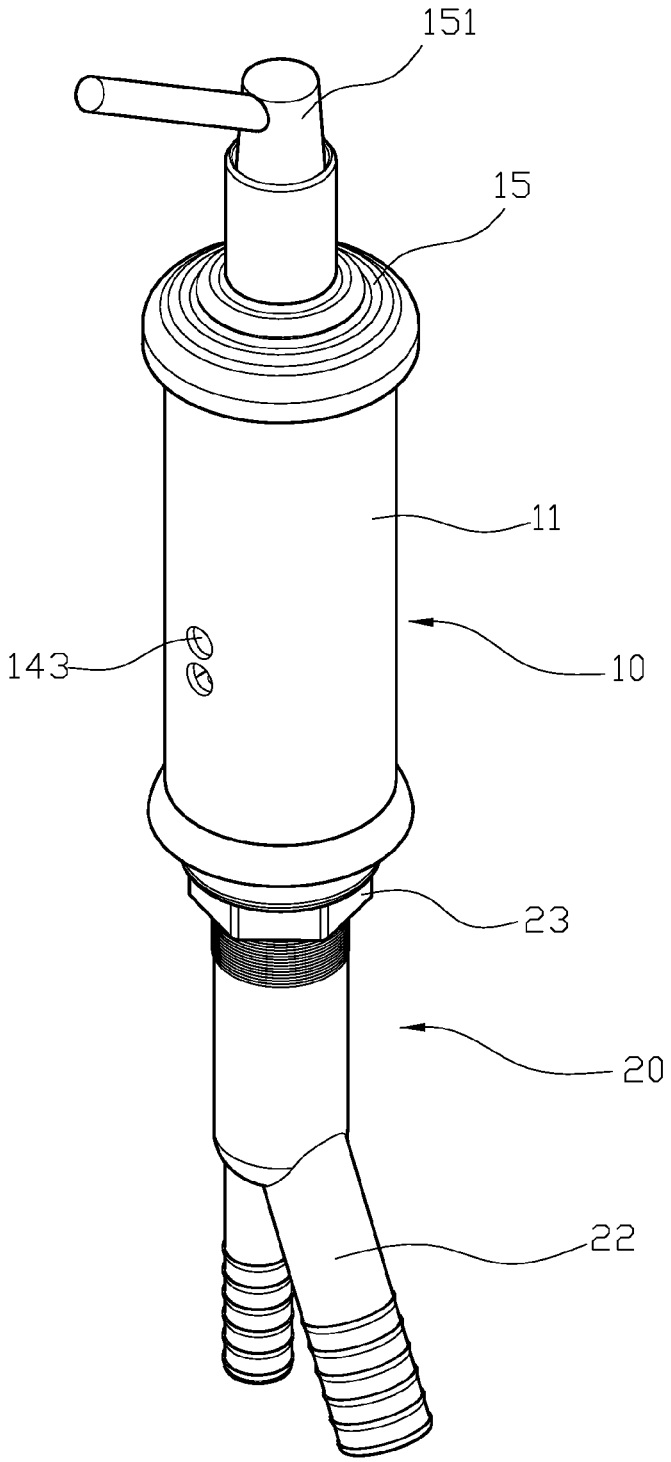
FIG. 1 illustrates a three-dimensional view of the present invention.
Figure 2:
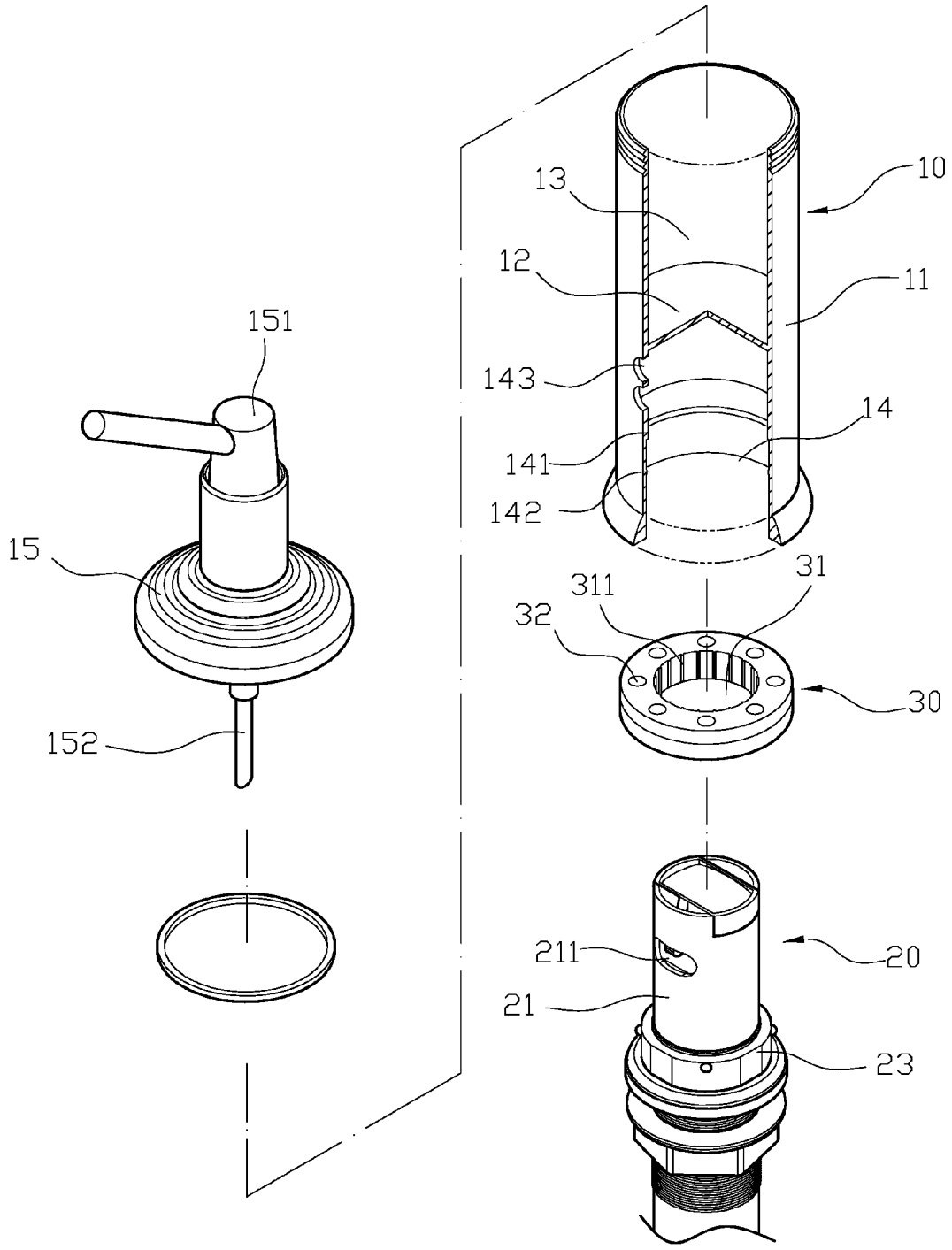
FIG. 2 illustrates an exploded view of the present invention.

In order to further understand the goal, characteristics and effect of the present invention, a number of embodiments along with the drawings are illustrated as following:

Referring to FIGS. 1 and 2, a soap dispenser may include a soap providing unit 10, an exhausting tube 20 and a fitting unit 30. The soap providing unit 10 has a container 11 that has a partition plate 12 creating a first receiving space 13 and a second receiving space 14, and a lid 15 is disposed on a top opening of the first receiving space 13. The lid 15 includes a pressing head 151, a suction tube 152 extending to the first receiving space 13. The second receiving space 14 has a stopper 141 at an inner wall thereof, and a positioning rib 142 is formed under the stopper 141 while a through hole 143 is formed above the stopper 141. The exhausting tube 20 has an exhausting pipe 21 and at least one inlet pipe 22 at a bottom portion of the exhausting tube 20, and one side of the exhausting pipe 21 has an exhausting hole 211. The fitting unit 30 that is made by plastic is located in the second receiving space 14 of the soap providing unit 10. A fitting hole 31 is formed at a center portion of the fitting unit 30, and a plurality of protruding ribs 311 is formed at an inner wall of the fitting hole 31. Also, a plurality of perforations 32 are formed at an outer periphery of the fitting hole 31.

Figure 3:
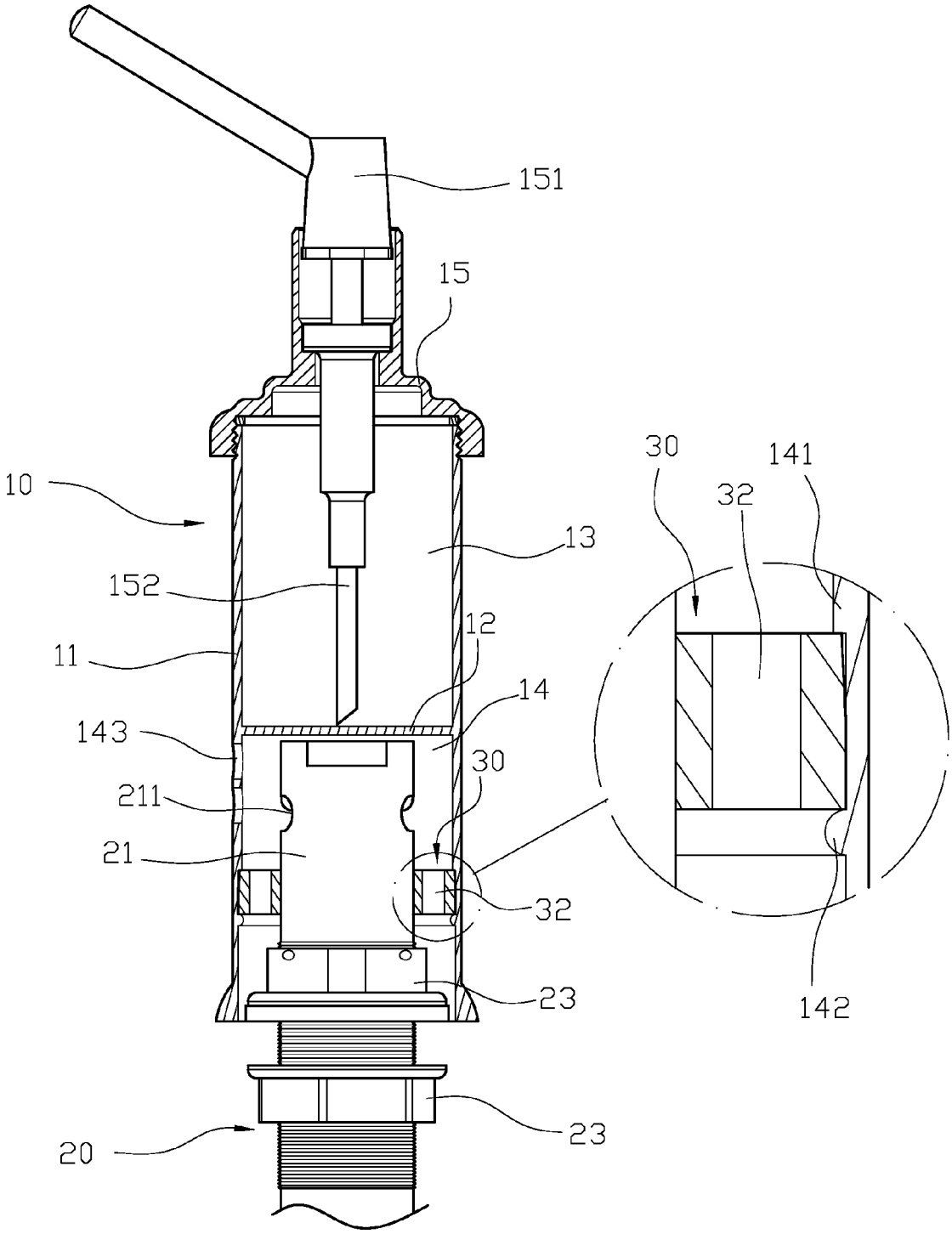
FIG. 3 illustrates a schematic sectional view and a partial enlarged view in the present invention.
Figure 4:
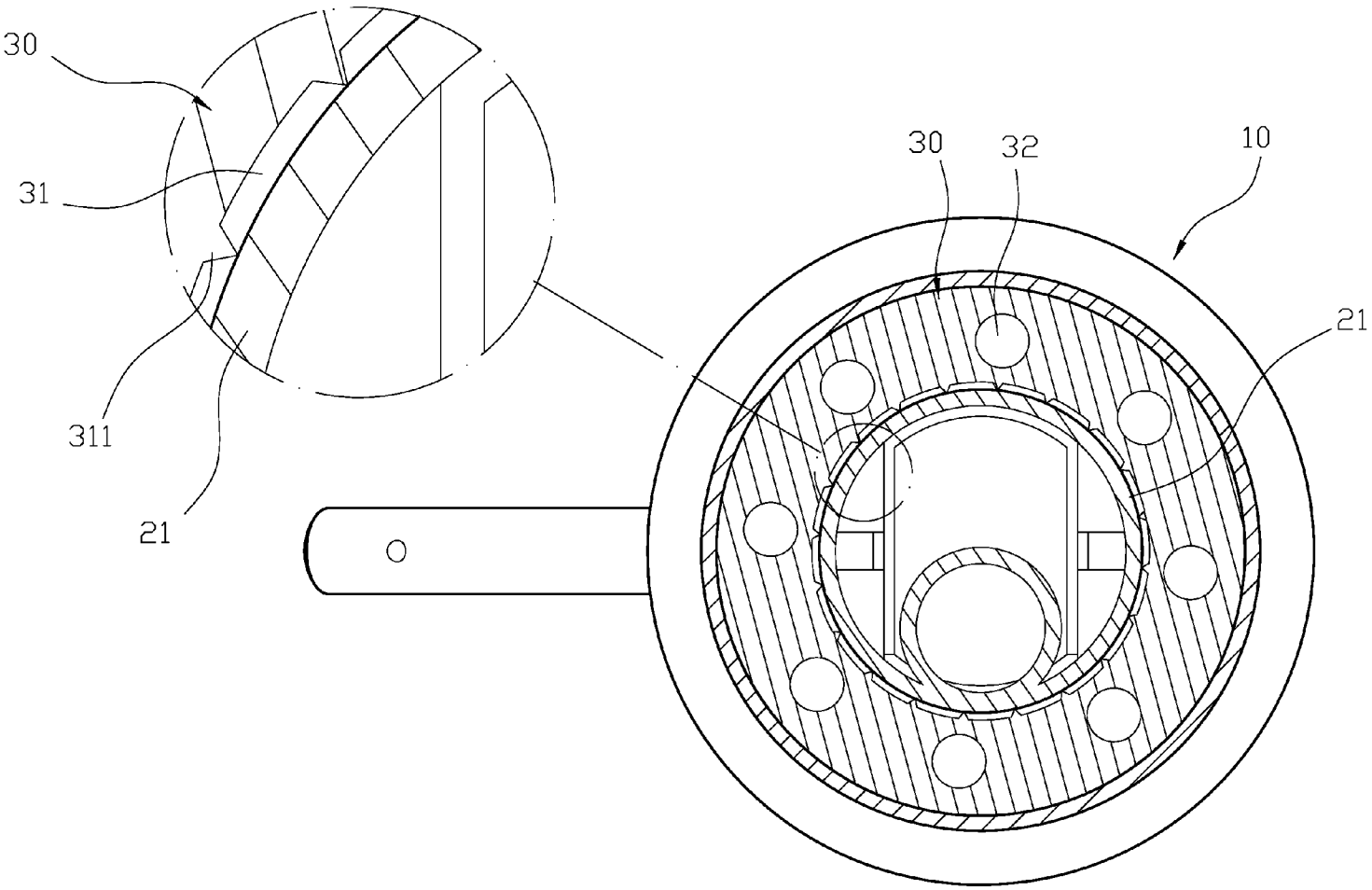
FIG. 4 illustrates a schematic sectional view and a partial enlarged view from another angle in the present invention.
Figure 5:
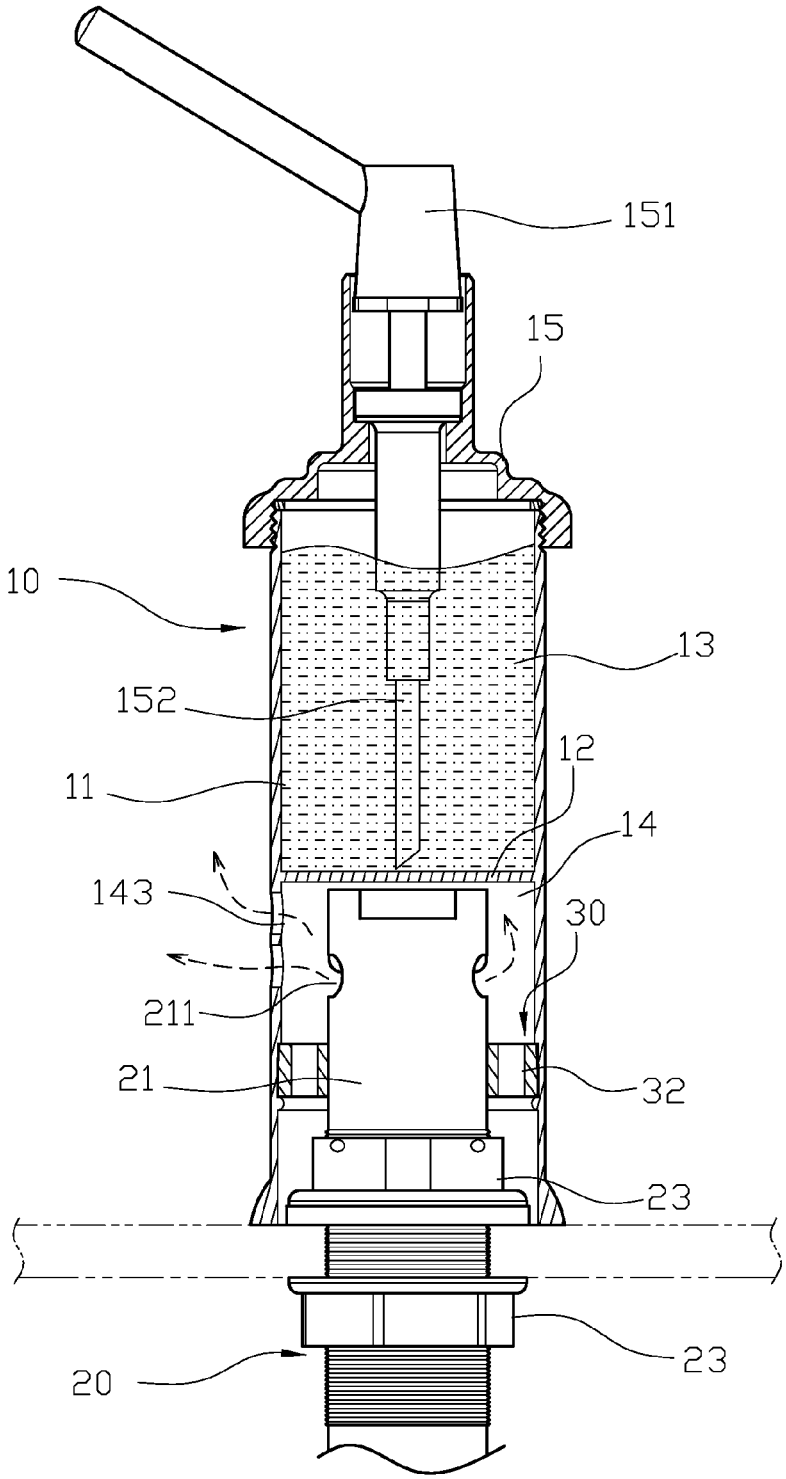
FIG. 5 illustrates a schematic view of the present invention when in use.
Figure 6:
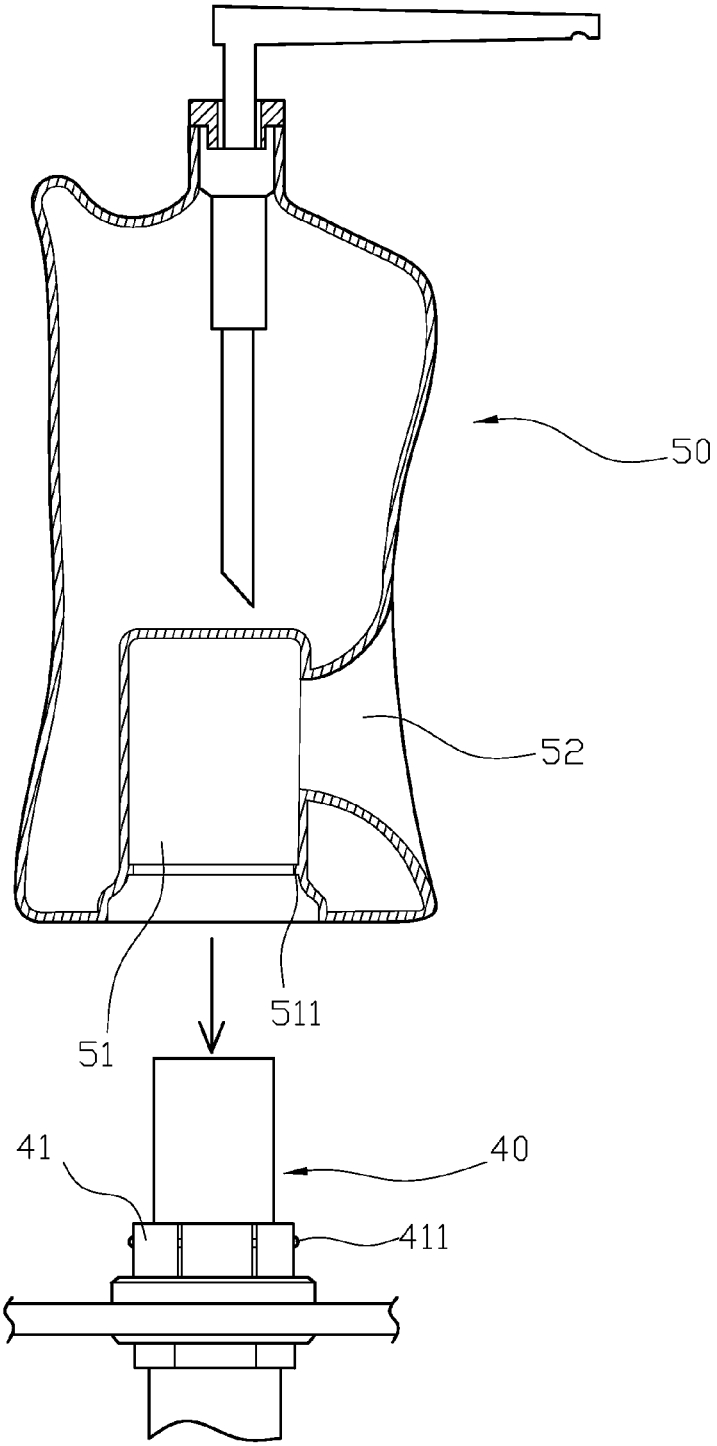
FIG.6 PRIOR ART
FIG. 6 illustrates a exploded view of a prior art
Figure 7:
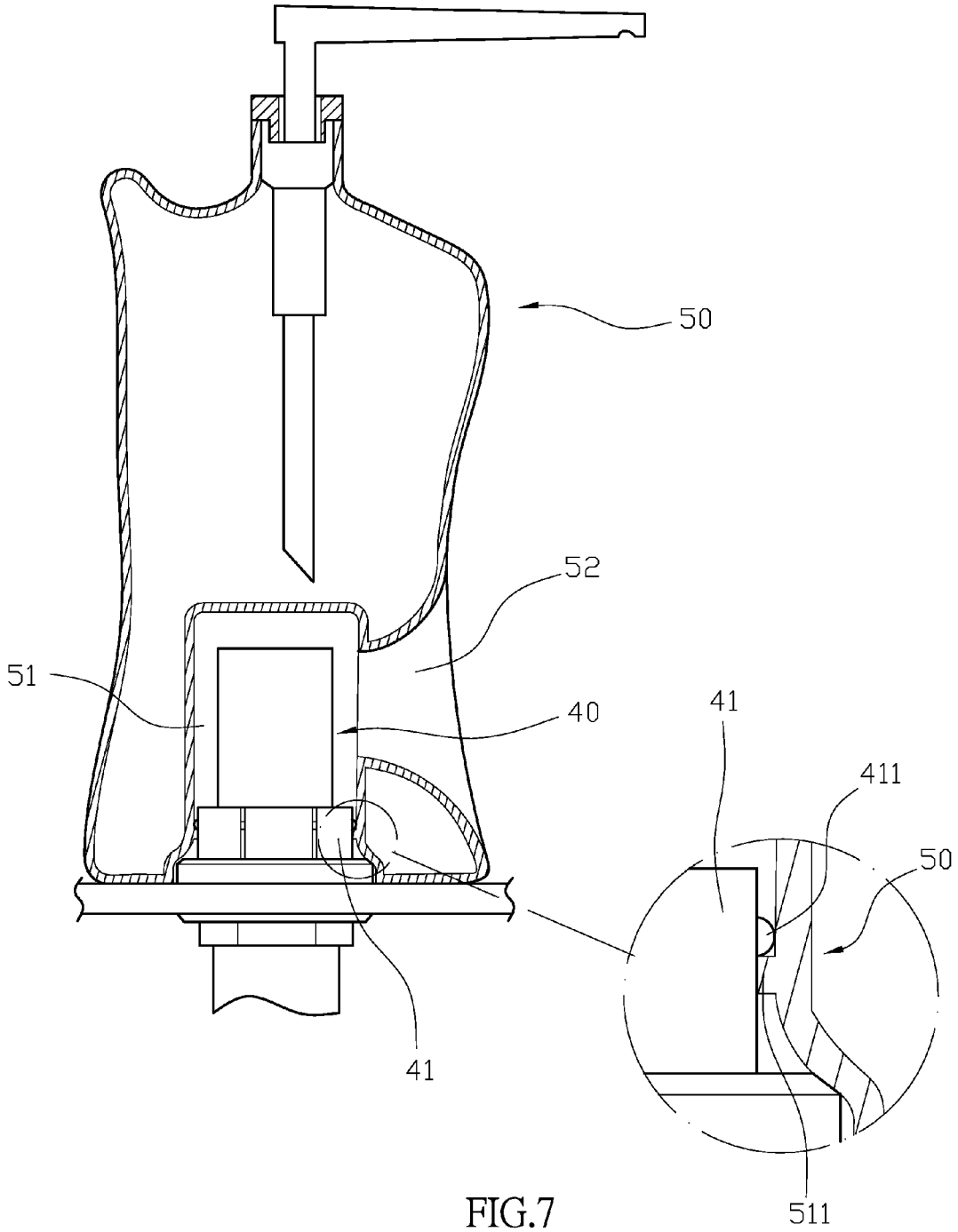
FIG.7 PRIOR ART
FIG. 7 illustrates a schematic view of the prior art.

Referring to FIGS. 2, 3 and 4, the exhausting tube 20 has two tightening pieces 23 fixed on the desktop, and the inlet pipe 22 is connected to the bottom of the desktop to connect to an exhausting end of the dishwasher or disposal machine, and the exhausting pipe 21 is extending and disposed on the desktop. The fitting unit 30 is disposed in the second receiving space 14, and more specifically, the fitting unit 30 is positioned between the stopper 141 and positioning rib 142, so when the exhausting pipe 21 is disposed in the second receiving space 14, the fitting hole 31 of fitting unit 30 is used to cover the exhausting pipe 21 and the protruding ribs 311 are used to secure the outer wall of the exhausting pipe 21, and the soap providing unit 10 can be securely positioned above the exhausting pipe 21. When exhaustion gas enters from the inlet pipe 22 at the bottom of the desktop into the exhausting pipe 20, the gas can be discharged through the exhausting hole 211 of the exhausting pipe 21. Furthermore, the through hole 143 is formed in the second receiving space 14 corresponding to the exhausting hole 211, so the exhaustion gas can be discharged from the through hole 143 into the air. Also, the first receiving space 13 of the soap providing unit 10 may contain house cleaning supplies, such as hand soap, dish detergents, etc. (as shown in FIG. 5), so the soap providing unit 10 can not only server the decoration purposes, but also provide an easy access for the users to hand soap and dish detergents.

According to the embodiments discussed above, the present invention is advantageous because (i) the fitting unit 30 is disposed in the second receiving space 14, and more specifically, the fitting unit 30 is positioned between the stopper 141 and positioning rib 142, so when the exhausting pipe 21 is disposed in the second receiving space 14, the fitting hole 31 of fitting unit 30 is used to cover the exhausting pipe 21 and the protruding ribs 311 are used to secure the outer wall of the exhausting pipe 21 and the soap providing unit 10 can be securely positioned above the exhausting pipe 21; and (ii) the fitting unit 30 is made by soft plastic materials so when the protruding ribs 311 are used to secure the outer wall of the outlet exhausting pipe 21, the friction during the assembly process of the exhausting tube 20 can be avoided to further reduce the chance of replacing the exhausting tube 20. Also, the fitting unit 30 is disposed in the second receiving space 14 of the soap providing unit 10, so when the soap providing unit 10 and the exhausting tube 20 cannot be smoothly connected, the user can replace the fitting unit 30.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A soap dispenser comprising:

soap providing unit having a container that has a partition plate creating a first receiving space and a second receiving space, and a lid disposed on a top opening of the first receiving space, the lid having a pressing head, a suction tube extending into the first receiving space, the second receiving space having a stopper at an inner wall thereof, a positioning rib formed under the stopper, and a through hole formed above the stopper;

an exhausting tube having an exhausting pipe and at least one inlet pipe at a bottom portion of the exhausting tube, and one side of the exhausting pipe having an exhausting hole; and a fitting unit made by plastic materials and located in the second receiving space of the soap providing unit, a fitting hole formed at a center portion of the fitting unit, and a plurality of vertical protruding ribs are formed at an inner wall of the fitting hole, wherein the fitting unit moves with the second receiving space and is positioned between the stopper and positioning rib, and an upper surface of the fitting unit is in contact with the stopper while a lower surface thereof is in contact with the positioning rib, so when the exhausting pipe is disposed in the second receiving space, the fitting hole of fitting unit is used to cover the exhausting pipe and the protruding ribs are secured on the outer wall of the exhausting pipe and the soap providing unit is securely positioned above the exhausting pipe.

2. The soap dispenser of claim 1, wherein a plurality of perforations are formed at an outer periphery of the fitting hole.

3. The soap dispenser of claim 1, wherein the exhausting tube includes two tightening pieces fixed on a desktop.

* * * * *